US007163488B2

(12) United States Patent
Anders et al.

(10) Patent No.: US 7,163,488 B2
(45) Date of Patent: Jan. 16, 2007

(54) FREE WEIGHT ASSISTANCE AND TRAINING DEVICE

(76) Inventors: Douglas H. Anders, 520 Lakehurst, Waterloo, NE (US) 68068; Ronald D. Walton, 5055 S. 161st Cir., Omaha, NE (US) 68135

( * ) Notice: Subject to any disclaimer, the term of this patent is extended or adjusted under 35 U.S.C. 154(b) by 195 days.

(21) Appl. No.: 10/826,212

(22) Filed: Apr. 17, 2004

(65) Prior Publication Data

US 2005/0233871 A1 Oct. 20, 2005

Related U.S. Application Data

(60) Provisional application No. 60/463,221, filed on Apr. 16, 2003.

(51) Int. Cl.
*A63B 24/00* (2006.01)

(52) U.S. Cl. ..... 482/4; 482/6; 482/8; 482/93; 482/104

(58) Field of Classification Search ..... 482/1–9, 482/900, 92, 93; 73/1.41, 1.42
See application file for complete search history.

(56) References Cited

U.S. PATENT DOCUMENTS 3,690,654 A * 9/1972 Hepburn et al. ..... 482/116
4,014,398 A * 3/1977 Gresko ..... 600/592
4,927,138 A * 5/1990 Ferrari ..... 482/91
4,986,534 A * 1/1991 Meier et al. ..... 482/8
4,998,721 A * 3/1991 Anders et al. ..... 482/4
5,048,826 A * 9/1991 Ryan ..... 482/7
5,314,394 A * 5/1994 Ronan ..... 482/104
5,554,089 A * 9/1996 Jones ..... 482/97
5,785,632 A * 7/1998 Greenberg et al. ..... 482/5
5,823,921 A * 10/1998 Dawson ..... 482/104
5,987,982 A * 11/1999 Wenman et al. ..... 73/379.08
6,228,000 B1 * 5/2001 Jones ..... 482/8
6,261,205 B1 * 7/2001 Elefson ..... 482/6
6,280,361 B1 * 8/2001 Harvey et al. ..... 482/8
6,293,892 B1 * 9/2001 Slawinski et al. ..... 482/104
6,358,188 B1 * 3/2002 Ben-Yehuda et al. ..... 482/8
6,379,287 B1 * 4/2002 Slawinski et al. ..... 482/104
6,632,159 B1 * 10/2003 Slattery ..... 482/94
6,949,052 B1 * 9/2005 Millington et al. ..... 482/8

* cited by examiner

*Primary Examiner*—Glenn E. Richmon
*Assistant Examiner*—Allana Lewin
(74) *Attorney, Agent, or Firm*—Adam H. Jacobs

(57) ABSTRACT

A free weight assistance and training device includes a base and a generally upright weight support structure mounted on and extending upwards from and over the base. A free weight support bar is connected to a computer-controlled weight tensioning device which is mounted on the base generally adjacent the upright weight support structure, the connection between the free weight support bar and the computer-controlled weight tensioning device consisting of at least two cables movably mounted on the upright weight support structure. The computer-controlled weight tensioning device, the at least two cables and the free weight support bar operatively cooperate with each other such that tensioning force applied by the computer-controlled weight tensioning device via the at least two cables to the free weight support bar controllably decreases the amount of downwards force exerted by the free weight support bar and weights thereon.

16 Claims, 5 Drawing Sheets

FREE WEIGHT ASSISTANCE AND TRAINING DEVICE

CROSS-REFERENCE TO RELATED APPLICATION

This application claims priority to the filing date of related patent application Ser. No. 60/463,221 filed Apr. 16, 2003.

BACKGROUND OF THE INVENTION

1. Technical Field

The present invention relates to weight training devices and, more particularly, to a free weight assistance and training device which includes a base, an upright weight support structure extending over and above the user of the device, a free weight support bar, a computer-controlled weight tensioning device mounted adjacent the upright weight support structure and a cable and pulley system extending over the upright weight support structure interconnecting the free weight bar and the weight tensioning device such that tensioning force applied by the weight tensioning device to the free weight support bar via the cable and pulley system is operative to decrease the amount of downwards force exerted by the free weight support bar, the device utilizing selected training methods through the computer-controlled weight tensioning device to produce desired workout results.

2. Description of the Prior Art

Even with the variety of exercise and muscle-building equipment and activities available, free weight lifting continues to be the workout method of choice for many athletes. Free weight lifting allows unrestrained motion during lifting, closely approximating application of human strength in many recreation and sporting activities. Also, the selection of weights utilized in free-weight lifting is highly repeatable as compared to machines employing levers, cams, and resistance elements such as springs and hydraulic or pneumatic cylinders. Furthermore, free weights provide uniform resistance unaffected by wear of mechanical parts and other components.

One disadvantage limiting use of free weights is the need for one or more spotters, especially in strength-building regimens that are intended to test the strength and endurance limits of the user. These regimens are most effective when the user continues repetitions until he or she is unable to lift the free weight bar. This is a safety concern if spotters are not immediately available since the user may be unable to safely lift the weight to a support device. Even when spotters are available, they may not recognize an unsafe condition or their response may not be quick enough to prevent injury.

Another disadvantage of free weights is that the amount of weight to be lifted is unchangeable during the lift, as once the weights are placed on the weight bar, weight cannot be added or subtracted during the lift. This means that if the weight user cannot lift the weight during the repetitions, he or she has to stop and not receive the full benefit of the workout. Although spotters can be of some assistance in providing partial assistance in the lifting of the free weight, the disadvantage of this assistance is that the spotter may assist too much or too little, and again the efficiency of the workout is compromised. There is therefore a need for a device which will provide the correct level of assistance for the free weight user yet will not interfere with the lifting process until needed.

Self-spotting machines, disclosed by others, have addressed eliminating the need for one or more spotters. For example, U.S. Pat. No. 4,949,959 discloses a barbell assist device utilizing a motor-driven yoke assembly. The yoke assembly provides cables that extend around sheaves and downwardly from each end of the housing to support a barbell over a weight bench. U.S. Pat. No. 5,048,826 discloses a device utilizing a winch assembly to retract and release cables supporting the barbell. U.S. Pat. No. 5,310,394 discloses a spotter system for weightlifters employing a pneumatic piston and cylinder. The cylinder provides lift assistance to the barbell through a lever arm, chain drive, pulley and cables.

However, none of the aforementioned devices provide independent support of both ends of the free weight bar. In fact, the assistance provided by these inventions does not accomplish the intended purpose of assisting with the lift without interfering with the lift, and therefore are inadequate for the purposes of this invention.

Many other devices have been proposed in the prior art which are intended to fulfill spotting and assisting purposes, each of which include inherent disadvantages and do not fully address the needs of the free weight user, particularly in connection with providing graduated assistance for lifting in connection with a specified exercise program. It is these needs that the present invention attempts to address and solve.

Therefore, an object of the present invention is to provide an improved free weight assistance and training device.

Another object of the present invention is to provide a free weight assistance and training device which includes a generally upright weight support structure, a free weight support bar and a computer-controlled weight tensioning device connected to the free weight support bar by at least two cables such that when the cables are tensioned, additional lifting power is applied to the free weight support bar to provide assistance to the user of the free weight assistance and training device during the lifting exercise.

Another object of the present invention is to provide a free weight assistance and training device which is designed to assist the user only to the extent that he or she needs in order to complete the exercise set and keep the free weight support bar moving during the exercise set.

Another object of the present invention is to provide a free weight assistance and training device which includes a computerized exercise tracking mechanism which tracks the user's weight lifting pattern to identify areas of instability or weakness so that the user may focus on those areas during subsequent lifting sessions.

Another object of the present invention is to provide a free weight assistance and training device which will perform all the duties of a spotter thus removing the need for a human spotter to assist the user of the present invention.

Finally, an object of the present invention is to provide a free weight assistance and training device which is sturdy and durable in construction and is safe and efficient in use.

SUMMARY OF THE INVENTION

The present invention provides a free weight assistance and training device which includes a base and a generally upright weight support structure mounted on and extending upwards from and over the base. A free weight support bar is connected to a computer-controlled weight tensioning device which is mounted on the base generally adjacent the upright weight support structure, the connection between the free weight support bar and the computer-controlled weight tensioning device consisting of at least two cables movably mounted on the upright weight support structure and extending between and connecting the free weight support bar and the computer-controlled weight tensioning device. The computer-controlled weight tensioning device, the at least two cables and the free weight support bar operatively cooperate with each other such that tensioning force applied by the computer-controlled weight tensioning device via the at least two cables to the free weight support bar controllably decreases the amount of downwards force exerted by the free weight support bar due to the weight of the free weight support bar and weights thereon whereby a user of the free weight assistance and training device may receive assistance during lifting of the free weight support bar via the computer-controlled weight tensioning device.

The present invention as thus described provides a substantial improvement over those devices found in the prior art. For example, because of the amount of assistance provided is variable depending on the speed of the lift and the weight being lifted, the user of the present invention receives maximum benefit from the exercise while minimizing the risk of injury due to improper spotting and/or assistance being provided. Also, because the computer system of the present invention tracks substantially all of the movements of the free weight bar both vertically and horizontally during the lift, the user of the present invention may quickly and easily determine whether his or her lifting style is the most efficient possible or even if the lifting style may eventually lead to injury. Furthermore, the design of the present invention means that the invention may be used for many different types of lifting exercises, and thus is not only restricted to bench work but also may be used for squats and other such standing exercises which cannot be done with other inventions found in the prior art. Finally, because of the numerous safety features of the present invention, the opportunity for injury is greatly reduced and the user of the present invention may thus safely and efficiently use free weights for his or her exercise program. It is thus clear that the present invention provides a substantial improvement over those devices found in the prior art.

DESCRIPTION OF THE PREFERRED EMBODIMENT

Figure 1:
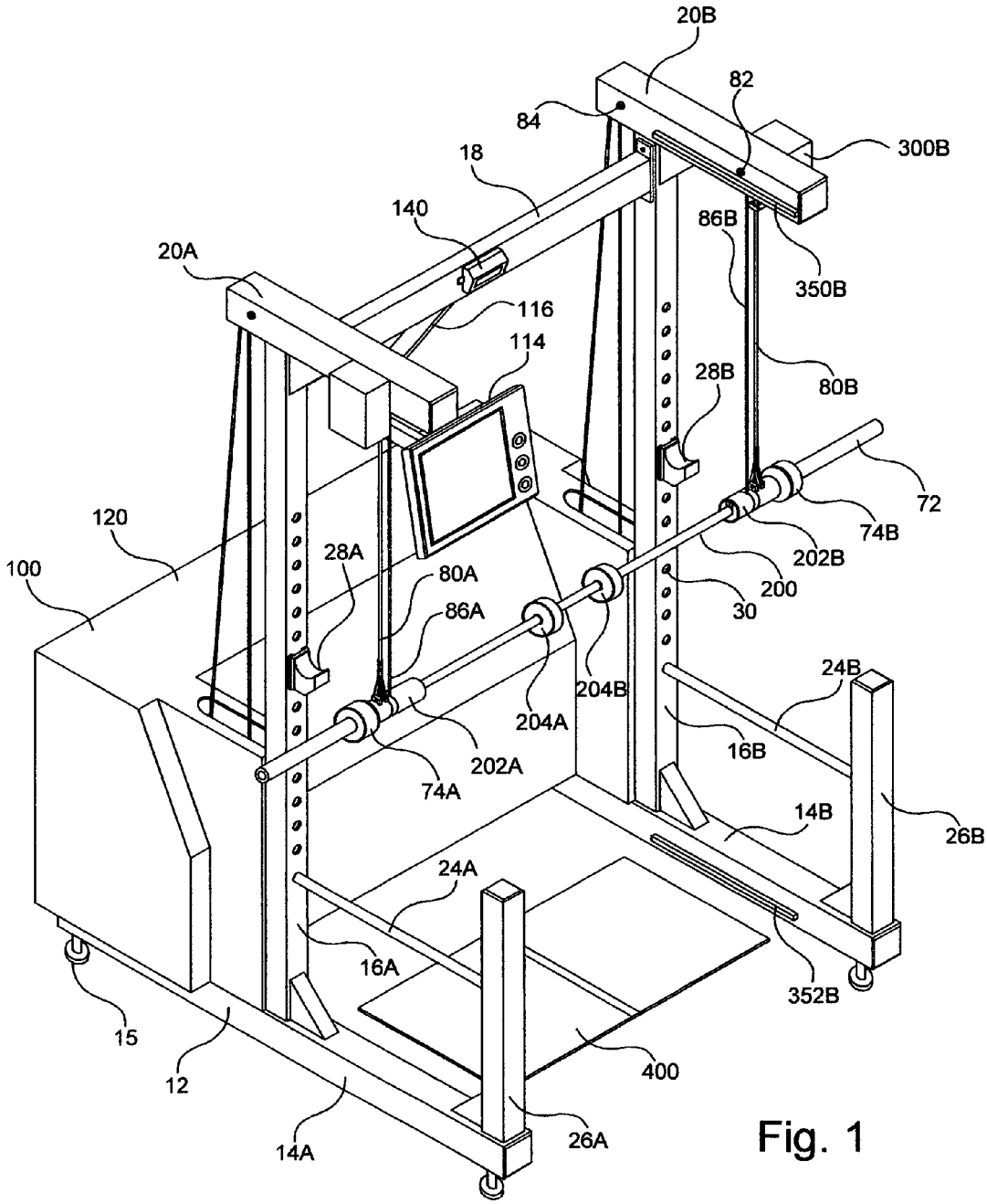
FIG. 1 is a perspective view of the free weight assistance and training device of the present invention.
Figure 2:
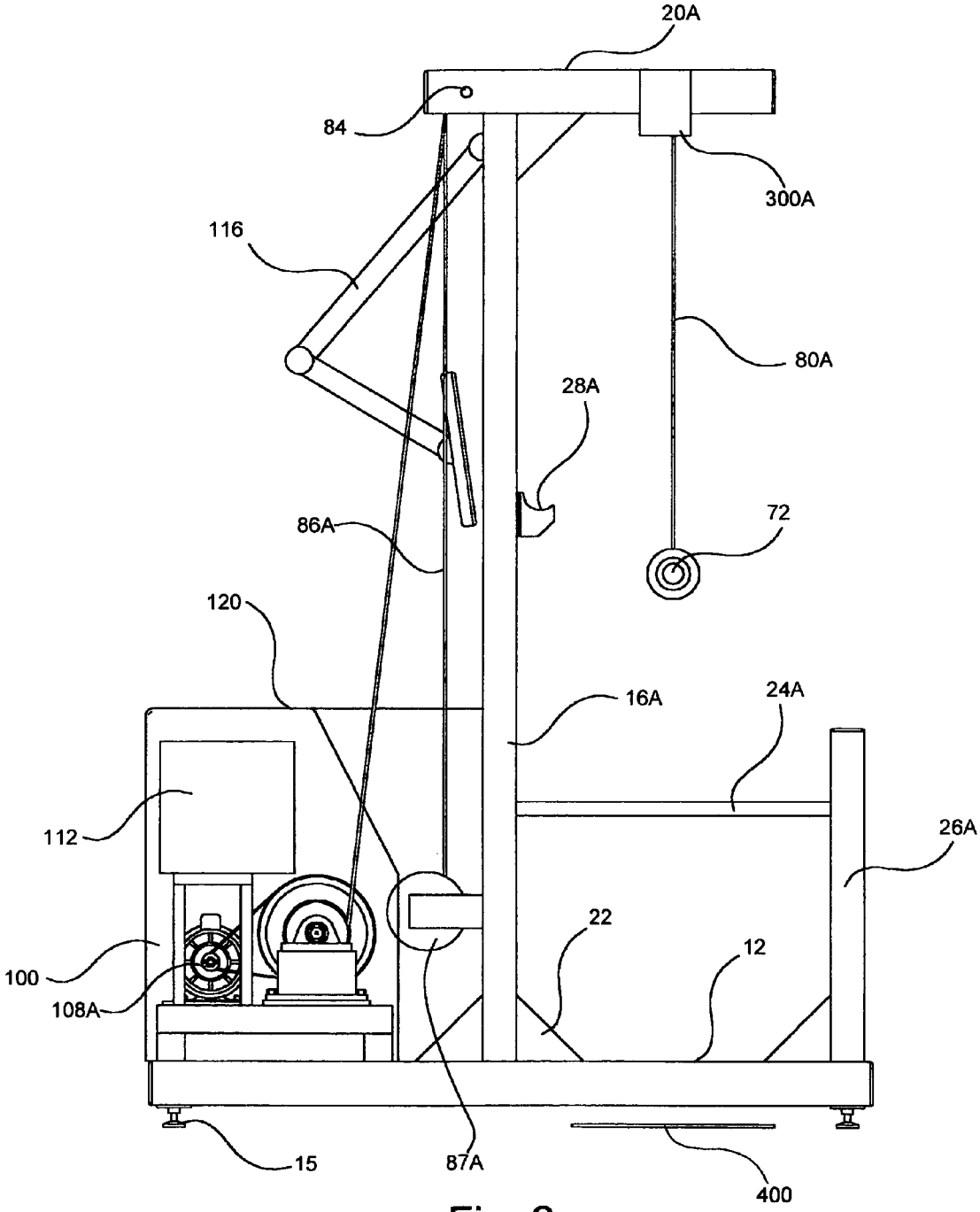
FIG. 2 is a side elevational view of the present invention.
Figure 3:
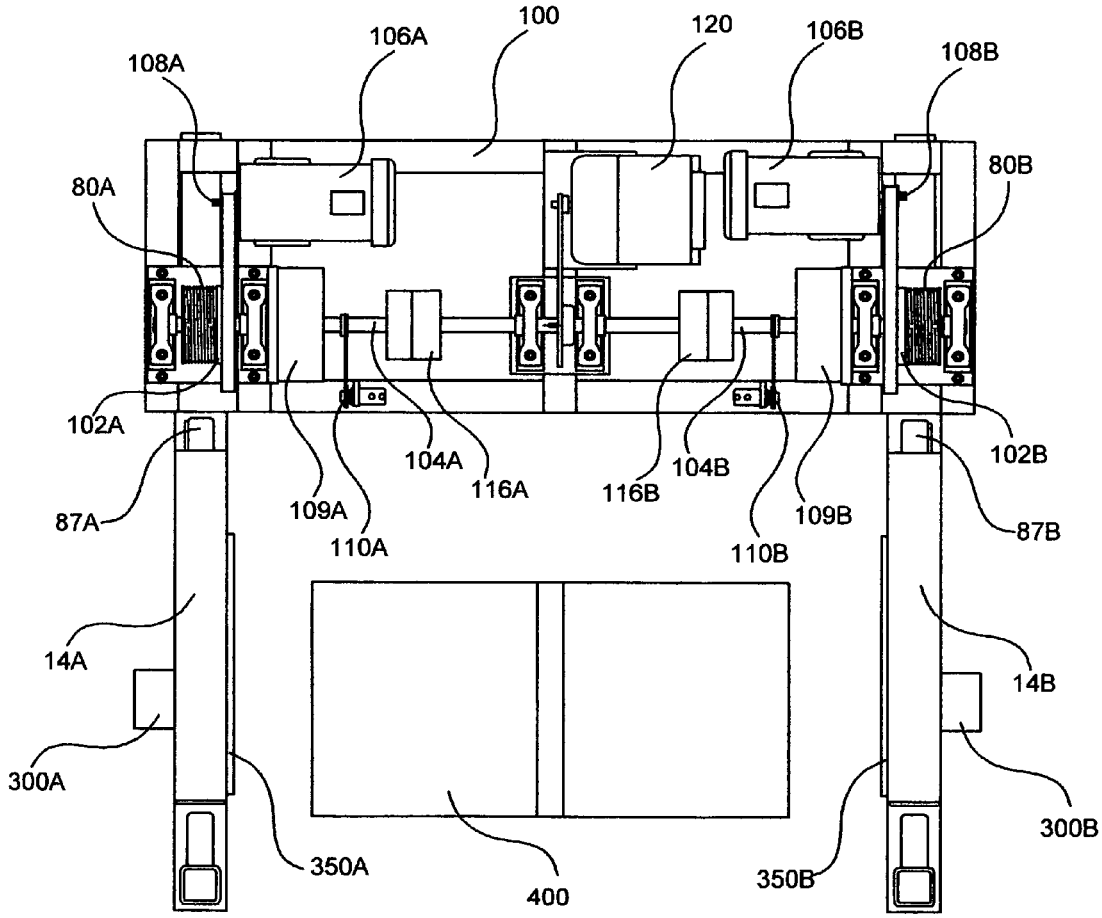
FIG. 3 is a detail top plan view of the specific features of the weight tensioning device of the present invention.

The free weight assistance and training device 10 of the present invention is shown best in FIGS. 1–3 as including three primary units, a generally upright weight support structure 12, a free weight support bar and connected cable system 70 and a computer-controlled weight tensioning system 100 which is operative to tension the cable system to decrease the amount of force which must be applied by a user of the invention to lift the free weight support bar. In the preferred embodiment, weight support structure 12 would include a pair of base feet 14*a* and 14*b* having leveling pads 15 mounted on the undersides thereof, and further on each of which is mounted an upright main weight support post 16*a* and 16*b* which each extend upward from the base feet 14*a* and 14*b* approximately sixty to one hundred twenty inches (60" to 120") depending on the intended use of the unit (i.e. bench press, snatch, curls, etc.). Furthermore, it is preferred that the base feet 14*a* and 14*b*, main weight support posts 16*a* and 16*b* and other elements of the weight support structure 12 of the present invention which cooperate to support the free weights will be constructed of sturdy steel box beams welded or bolted to one another to ensure that the weights are safely and sturdily supported at all times to prevent injury to the user of the invention. Of course, any appropriate construction material may be used with the present invention so long as the safety of the user is maintained.

A cross brace beam 18 extends between and connects the main weight support posts 16*a* and 16*b* adjacent the upper sections thereof for securing the main weight support posts 16*a* and 16*b* in spaced apart, generally parallel relation. Mounted atop each of the main weight support posts 16*a* and 16*b* is a weight support beam 20*a* and 20*b* each of which extend forwardly generally parallel with each other approximately ten to thirty inches (10" to 30") from the main weight support posts 16*a* and 16*b*, as shown best in FIGS. 1 and 2. To increase the structural stability of the weight support structure 12, it is further preferred that a number of generally triangular gussets 22 be mounted on the weight support structure 12 adjacent the connections between the main weight support posts 16*a* and 16*b* and the base feet 14*a* and 14*b* and the weight support beams 20*a* and 20*b*. The gussets 22 stabilize the connections and act to prevent collapse of the weight support structure 12 even if a large amount of weight is being supported by the device 10 of the present invention.

The free weight support bar and connected cable system 70 of the present invention is best shown in FIGS. 1 and 2 as including a free weight support bar 72 on which are mounted left and right weight stops 74*a* and 74*b* which cooperate to position weight plates (not shown) correctly on the free weight support bar 72. Two weight support cables 80*a* and 80*b* are each respectively connected to one of the left and right weight stops 74*a* and 74*b* and extend upwards therefrom, the weight support cables 80*a* and 80*b* being constructed of wire or Kevlar cable having a high tensile strength to ensure safe operation of the present invention. The weight support cables 80*a* and 80*b* extend into the weight support beams 20*a* and 20*b* and as the weight support cables 80*a* and 80*b* are supported within the weight support beams 20*a* and 20*b* in substantially the same manner, the following description of the support features of weight support beam 20*a* should be understood to apply equally to the support features of weight support beam 20*b*.

Weight support cable 80*a* extends into the hollow interior of weight support beam 20*a* where it passes over and engages forward pulley 82 rotatably mounted within the forward section of weight support beam 20*a* and oriented generally parallel with the base foot 14*a*. As the weight support cable 80*a* extends rearwardly through the weight support beam 20*a*, it passes over and engages rearward pulley 84 rotatably mounted within the rearward section of weight support beam 20*a* and oriented generally parallel with forward pulley 82. The weight support cable 80*a* then extends downwards to the computer-controlled weight tensioning system 100 which tensions the weight support cable 80*a* according to the programming and weight training regimen selected by the user of the present invention. Of course, the forward and rearward pulleys 82 and 84 may be modified or replaced by slides or other such cable guides so long as the weight support cable 80*a* is guided through the weight support beam 20*a*.

Figure 4:
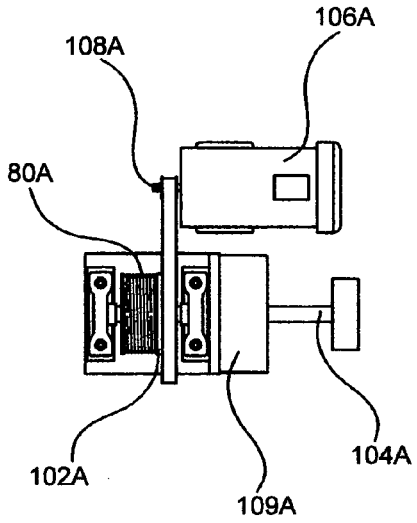
FIG. 4 is a top plan view of the cable tensioning device of the present invention showing the operative elements of the device.
Figure 5:
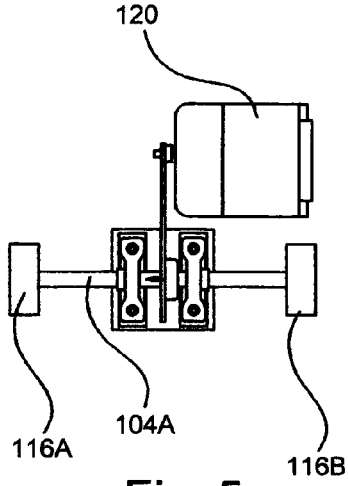
FIG. 5 is a top plan view of the winching device of the present invention.

The computer-controlled weight tensioning system 100 is shown best in FIGS. 2, 3 and 4 as including a pair of threaded cable reels 102*a* and 102*b* which are mounted on rotatably mounted reel shafts 104*a* and 104*b* which permit the cable reels to rotate to extend or retract the weight support cables 80*a* and 80*b* which are wound thereon. The threading on the cable reel surface of each of the cable reels 102*a* and 102*b* ensure accurate take-up of the cables 80*a* and 80*b*, i.e. each rotation of the cable reels 102*a* and 102*b* takes up an identical length of cable. The drive shafts 108*a* and 108*b* of a pair of drive motors 106*a* and 106*b* are operatively connected to the cable reels 102*a* and 102*b* to rotate them in response to rotation of the drive shafts 108*a* and 108*b*. Sensor units 110*a* and 110*b* are mounted adjacent the reel shafts 104*a* and 104*b*, the sensor units 110*a* and 110*b* operative to detect the rotational speed, direction and amount of rotation of the reel shafts 104*a* and 104*b* and transfer that information to a computer-based control mechanism 112. In the preferred embodiment, the sensor units 110*a* and 110*b* are "encoders", that is, they are optical disks that have alternating light and dark radial sections which count the number and speed of the pulsations and forwards that information to the computer-based control mechanism 112. In this manner the speed, direction and number of rotations of each of the reel shafts 104*a* and 104*b* is fed to the computer-based control mechanism 112 for further processing. The encoders establish the "windows" as described below and the speed for the lift and fall of the free weight support bar 72.

While the drive shafts 108*a* and 108*b* and reel shafts 104*a* and 104*b* cooperate to control the lift assistance provided to the user of the present invention, in the event the need arises to change the vertical positions of the bar 72. Therefore, the lifting of the entire free weight support bar 72 is preferably performed by a separate lift motor 120 which engages the reel shafts 104*a* and 104*b* through the locking of clutches 116*a* and 116*b*. This enables the lift motor 120 to rotate the reel shafts 104*a* and 104*b* and the cable reels 102*a* and 102*b* to wind the cables 80*a* and 80*b* to raise or lower the free weight support bar 72 by overpowering the drive motors 106*a* and 106*b*. Finally, the release of cable from cable reels 102*a* and 102*b* is controlled by a pair of reel brakes 109*a* and 109*b* which prevent rotation of the reel shafts 104*a* and 104*b* upon receiving a signal from the computer-based control mechanism 112.

The computer-based control mechanism 112 is operatively connected to the drive motors 106*a* and 106*b* to command the drive motors 106*a* and 106*b* to rotate drive shafts 108*a* and 108*b* to provide powered assistance to the reels 102*a* and 102*b* in lifting the free weight support bar 72 via the weight support cables 80*a* and 80*b*. In the preferred embodiment, the computer-based control mechanism 112 would be a standard computing device incorporating a hard drive, motherboard with processor, memory, and other necessary elements for performing computing operations. For inputting information into the computer-based control mechanism 112, a touch-activated computer screen 114 is mounted on and adjustable on support member 116 which in turn is mounted on and extends downwards from cross brace beam 18, as shown best in FIGS. 1 and 2, although the exact location of the computer screen 114 or, for that matter, any appropriate input device, would be determined according to user preferences and may be in any location on or adjacent the free weight assistance and training device 10. In the preferred embodiment, the touch-activated computer screen 114 permits the user of the present invention to enter specific workout data, including such information as the user's name, and identifying code number, and other information to identify the user of the present invention. The user would then be able to enter information connected directly with the exercise routine which is to be performed, including such details as high and low point ranges of the lift being performed, the lift off weight to be removed from the weight being lifted to enable proper motion during the lift, a window, which would be the distance the free weight support bar 72 can travel downwards before assistance is provided by the weight tensioning system 100 and the assist speed, which is the determination of the amount of time the user of the invention will receive before assistance is applied while doing the specified lift. Of course, other forms of data input devices such as keyboards and disk drives may be used to input information, and many other types of additional information may be entered using the touch-activated computer screen 114 depending on the specific programming features of the computer-based control mechanism 112, all of which may be used by the free weight assistance and training device 10 of the present invention to provide enhanced workouts. Finally, a digital readout 140 is mounted on the cross brace beam 18 or another readily viewable location, the digital readout 140 connected to the computer-based control mechanism 112 and operative to display the lift assistance in pounds or the like relating to the lift being performed.

Prior to beginning discussion of the operation and use of the present invention, the remaining physical features shown in FIGS. 1–3 will be described herein. In the preferred embodiment, the computer-controlled weight tensioning system 100 would further include a housing 120 which completely covers and encloses each of the features described in connection with the computer-controlled weight tensioning system 100 save the touch-activated computer screen 114. In this manner, accidental touching of the components by the user is prevented, thus increasing the safety of the device. Additional safety features which are incorporated into the present invention include a pair of safety bars 24*a* and 24*b* which extend generally horizontally forwards from main weight support posts 16*a* and 16*b* with the forward ends of the safety bars 24*a* and 24*b* being supported by a pair of generally upright weight support bar posts 26*a* and 26*b* each mounted on and extending upwards from one of the base feet 14*a* and 14*b*. In operation, safety bars 24*a* and 24*b* are positioned below the lower range limit of movement of the free weight support bar 72 to prevent the free weight support bar 72 from injuring the lifter in the event of emergency release of the free weight support bar 72. Finally, a pair of weight support brackets 28*a* and 28*b* are adjustably mounted on the main weight support posts 16*a* and 16*b*. The main weight support posts 16*a* and 16*b* would preferably include a plurality of vertically spaced mounting holes 30 formed in the forward wall of each of the main weight support posts 16*a* and 16*b*, the holes 30 operative to receive and secure the weight support brackets 28*a* and 28*b* in a specified vertical position along main weight support posts 16*a* and 16*b*. In this manner, a user of the invention may move the free weight support bar 72 rearwardly on the machine until the free weight support bar is positioned over the weight support brackets 28*a* and 28*b* and thus release of the free weight support bar 72 downwards removably positions the free weight support bar 72 on the weight support brackets 28*a* and 28*b*. In this manner, various types of exercises may be performed by the user of the present invention, such as overhead presses, curls, and other such exercises in which the free weight support bar 72 would not be returned to its lowermost resting position as defined by the weight support bars 24*a* and 24*b*. Finally, a pair of take-up reels 87*a* and 87*b* are mounted within the housing 120 and are connected to the handle sensor cables 86*a* and 86*b* to alternatively take up or release cable during the exercise being performed to ensure that slack does not develop in the handle sensor cables 86*a* and 86*b* thus preventing interference with the exercise.

Figure 6:
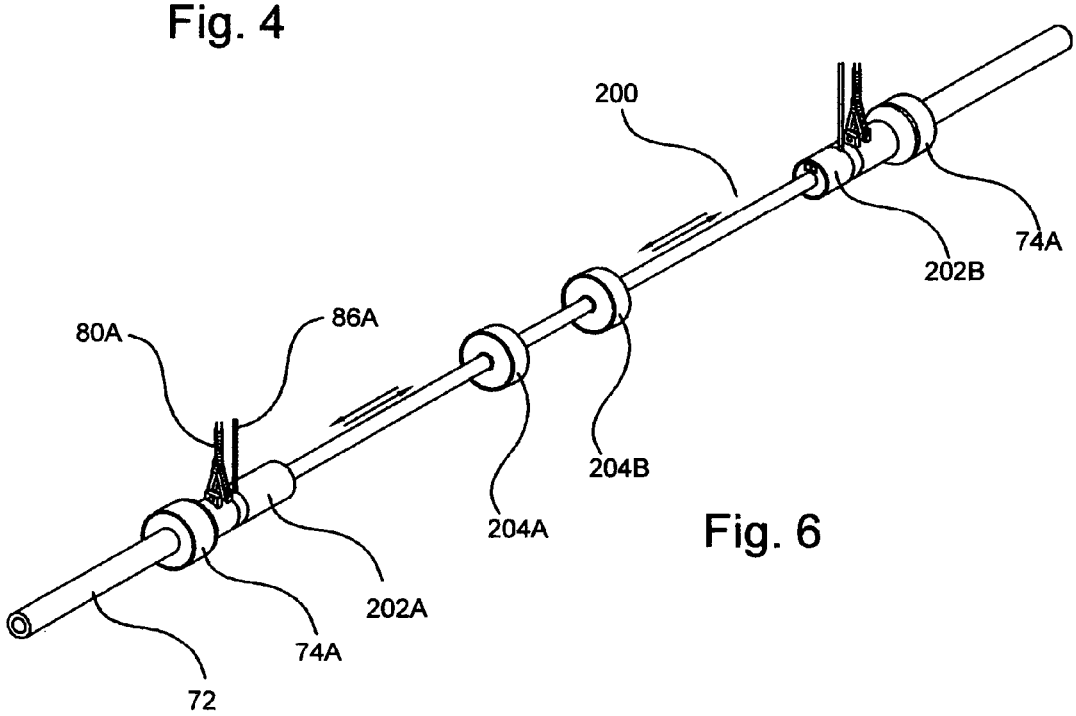
FIG. 6 is a detail perspective view of the free weight support bar of the present invention.
Figure 7:
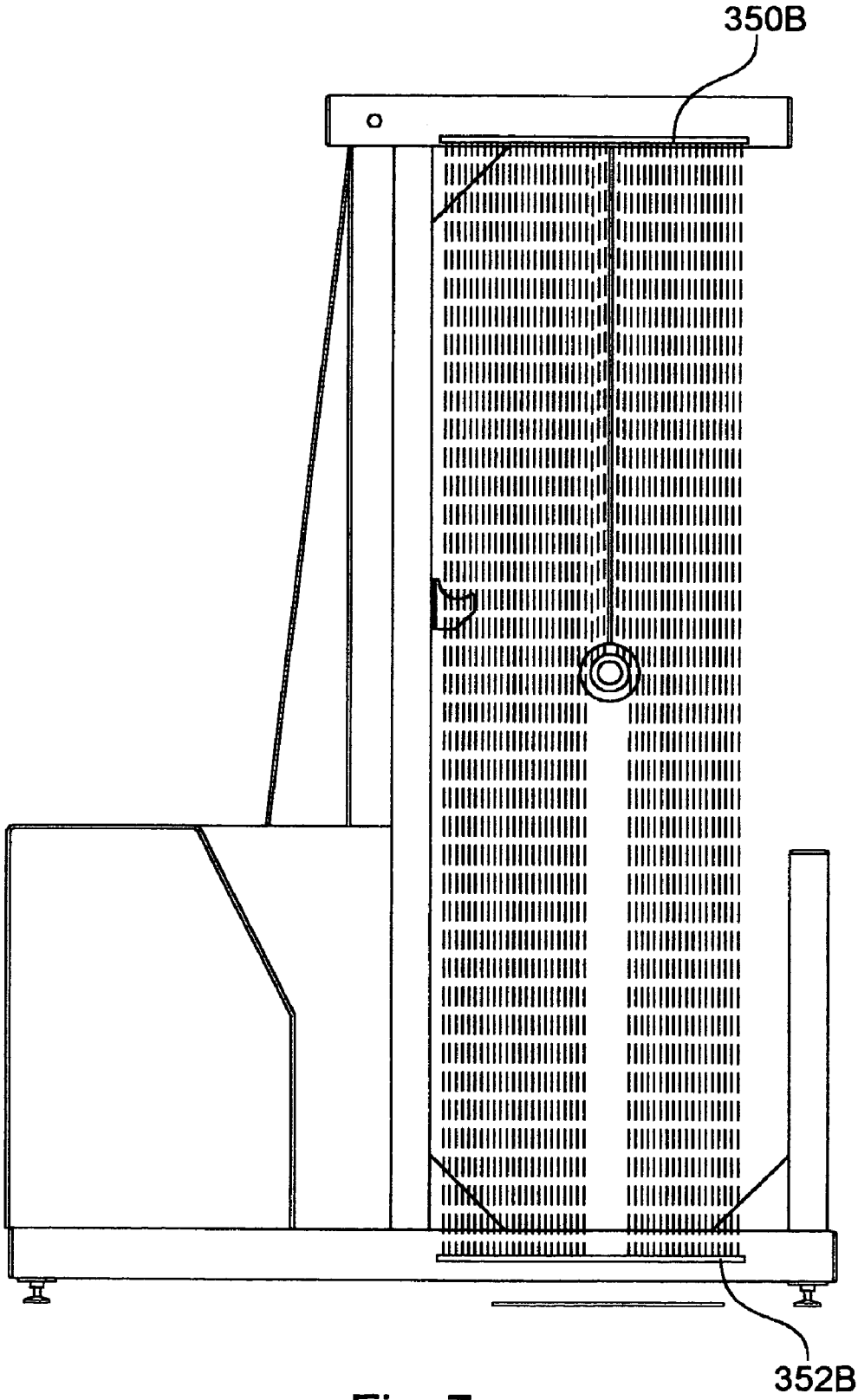
FIG. 7 is a side elevational view of the bar position detection device of the present invention showing the operative elements of the device.

One of the most important safety features of the present invention involves the handle grip sensing device 200 which is mounted on the free weight support bar 72 and shown best in FIGS. 1 and 6. In the preferred embodiment, the handle grip sensing device 200 would include a pair of light-sensitive sensing units 202*a* and 202*b* mounted on the free weight support bar 72, one adjacent each of the left and right weight stops 74*a* and 74*b* and each facing inwards towards the center of free weight support bar 72. Slidably mounted on the free weight support bar 72 adjacent the center thereof are a pair of reflective disks 204*a* and 204*b* which may be moved towards or away from the sensing units 202*a* and 202*b* depending on the exercise being performed and the hand position on the free weight support bar 72. In the preferred embodiment, the sensing units 202*a* and 202*b* would send infrared beams of light (shown as the back-and-forth arrows on FIG. 6) outwards therefrom extending generally parallel with the free weight support bar 72. When the beams encounter the reflective disks 204*a* and 204*b*, they are reflected back to the sensing units 202*a* and 202*b* signifying that no one is using the free weight assistance and training device 10 of the present invention. When a user places his or her hands on the free weight support bar 72 in preparation to do an exercise, however, the light beams are interrupted and the sensing units 202*a* and 202*b* send this information to the computer-based control mechanism 112 via handle sensor cables 86*a* and 86*b*. During the exercise, the computer-based control mechanism 112 checks to make sure that the free weight support bar 72 is still being gripped by the user of the invention, and if at any time the sensing units 202*a* and 202*b* recognize that the hands of the user have left the free weight support bar 72, the computer-based control mechanism 112 locks the reel brakes 109*a* and 109*b* and prevents the free weight support bar 72 from either raising or lowering until the situation is rectified.

The following description of one type of exercise being performed with the free weight assistance and training device 10 of the present invention should be understood to apply generally to other types of exercise motions to be performed with the invention, but is believed that the following description is illustrative of the use of the present invention. For the standard bench press exercise, a user of the invention would position him or herself in a generally horizontal position underneath the free weight support bar 72 on a bench or the like. Of course, prior to positioning him or herself beneath the free weight support bar 72, the user of the present invention would enter his or her personal information into the computer-based control mechanism 112 of the touch-activated computer screen 114. As was stated previously, this information would define the parameters of the exercise to be performed and would include vital information such as the weight being used, assistance to be provided, and range of motion desired, specifically directed to such critical details as the windows of movement for the exercise and the liftoff position for the exercise. Once the user of the present invention is positioned beneath the free weight support bar 72, the reflective disks 204*a* and 204*b* are slid into proper position and the desired amount of weight is mounted onto the ends of free weight support bar 72. The exercise regimen now can begin. As the user lifts the free weight support bar upwards from weight support bars 28*a* and 28*b*, the computer-based control mechanism 112 provides a degree of assistance referred to as the liftoff assistance, in which a percentage of the overall weight of the free weight support bar 72 and weights mounted thereon is taken up by a rotation of the drive shafts 108*a* and 108*b* of drive motors 106*a* and 106*b* which drive cable reels 102*a* and 102*b* to apply tension to weight support cables 80*a* and 80*b* thus removing a portion of the weight on the free weight support bar 72 therefrom. As the lift continues, the computer-based control mechanism 112 signals the drive motors 106*a* and 106*b* to continue reeling in the weight support cables 80*a* and 80*b* to prevent slack forming in the cables until the upper limit is reached. The lifter lowers the bar to the lower limit and then it is the user of the invention who is providing the upwards force to raise the free weight support bar 72 and weights mounted thereon until such time as the computer-based control mechanism 112 detects that motion of the free weight support bar 72 has slowed or stopped after the free weight support bar 72 has left its lower limit. In the preferred embodiment, a small time delay would be instituted between the time the computer-based control mechanism 112 detects stopping of the raising of the free weight support bar 72 by the user and the instigation of powered assistance by the computer-based control mechanism 112 via the cable reels 102*a* and 102*b* in order to give the user of the present invention every opportunity to maximize the intensity of the workout.

At some point, however, the user of the present invention will be unable to lift the entire amount of the weight of the free weight support bar 72 and weights mounted thereon. The free weight assistance and training device 10 detects this by sensing the cessation of motion of the free weight support bar 72, as detected by the sensor units 110*a* and 110*b*. At this time that the computer-based control mechanism 112 increases the tension of the drive motors 106*a* and 106*b* to rotate drive shafts 108*a* and 108*b* to rotate the cable reels 102*a* and 102*b* to tension the weight support cables 80*a* and 80*b* thus removing a portion of the weight of the free weight support bar 72 and weights mounted thereon in incremental stages until the user is able to continue the lift. The user of the present invention is thus able to continue his or her lifting motion and reach maximum intensity for the workout without being concerned about his or her ability to simply raise or lower the free weight support bar 72. This reactive ability of the computer-based control mechanism 112 to assist the user of the present invention by lifting a variable portion of the total weight being lifted is a unique and valuable attribute of the present invention. In fact, it has been found that, through the use of the present invention, workout routines are greatly enhanced and the lifting of progressively heavier weights may be incorporated into the workout routine without the risk of accidental release of the free weight support bar 72 due to muscle failure. Furthermore, it can easily be seen that the present invention may be used for a large variety of weight lifting routines by merely modifying the parameters of use, including the weight being used, assistance supplied, range of motion, and time delay between muscle failure and assistance being provided. Additional details of the preferred operation of the present invention may be found in the attached Appendix "A", in which a listing of the preferred general operational and computer procedures for the present invention are disclosed. Of course, Appendix "A" should be seen as providing examples of the use of the present invention and is not limiting in any manner as to the intended functionality and uses of the present invention.

Additional features of the present invention are shown in FIGS. 1, 2, 3 and 7 and include a balance pad 400 placed on the floor surface between base feet 14*a* and 14*b*. The balance pad 400 is connected in information transmission connection with the computer-based control mechanism 112 to track weight distribution of the lifter during the lift for increasing efficiency of the lift. This will allow the lifter to focus on particular elements of the lift to eliminate potentially harmful poor technique.

One of the truly unique elements of the present invention, however, is the bar position detector device which consists of two interconnected elements, the cable angle detection devices 300*a* and 300*b* and the bar position detection light curtains 350*a* and 350*b*, each of which are connected in information transmission connection with the computer-based control mechanism 112, and which cooperate to determine the position of the free weight support bar 72 at all times during the lift. The cable angle detection devices 300*a* and 300*b* are mounted on each weight support beam 20*a* and 20*b* and positioned each adjacent the forward edge of one of the pulleys 82 to detect the angles at which the cables 80*a* and 80*b* depend from the weight support beams 20*a* and 20*b*. The angle combined with the length of cable depending from the weight support beam 20*a* and 20*b* will track the location of the free weight support bar 72 to permit the user of the present invention to maintain a better lift track during the lift thus reducing the chance of injury from improper lifting.

The bar position detection light curtains 350*a* and 350*b* are likewise mounted on the weight support beams 20*a* and 20*b* and extend generally parallel therewith, the bar position detection light curtains 350*a* and 350*b* operative to project a light/laser curtain generally vertically downwards to a receiver bar 352*a* and 352*b*, one mounted on each of the base feet 14*a* and 14*b*, such that any interruption in the light curtain is noted by the computer-based control mechanism 112 to which the bar position detection light curtains 350*a* and 350*b* are connected in information transmission connection. As the free weight support bar 72 is moved through the bar position detection light curtains 350*a* and 350*b*, the horizontal interruptions of the light curtain are recorded and the computer-based control mechanism 112 or associated computer can calculate and graph the path of the free weight support bar 72 during the lift.

By combining the results from the cable angle detection device 300 and the bar position detection light curtain 350*a* and 350*b*, the track of the lift may be plotted and the user of the present invention can obtain a visual representation of the lift. This data can then be used by the lifter to remedy poor lifting technique before the lifting technique can cause him or her injury. This improvement is not found in the prior art and is a novel and unique feature of the present invention.

It is to be understood that numerous additions, substitutions and modifications may be made to the free weight assistance and training device 10 which fall within the intended broad scope of the above description. For example, the size, shape and construction materials used in connection with the present invention may be modified or changed so long as the intended functionality of the invention is not degraded or destroyed. Furthermore, the specific programming features of the present invention may be modified or changed to permit the present invention to be used with a variety of different exercise and weightlifting programs. Finally, it should be noted that the design features of the present invention are generally not critical to the present invention so long as the intended functionality of the invention is maintained.

There has therefore been shown and described an free weight assistance and training device which accomplishes at least all of its intended objectives.

We claim:

1. A free weight assistance and training device comprising:

a base;

a generally upright weight support structure mounted on and extending upwards from and over said base;

a free weight support bar;

a computer-controlled weight tensioning device mounted on said base generally adjacent said upright weight support structure;

at least two cables movably mounted on said upright weight support structure and extending between and connecting said free weight support bar and said computer-controlled weight tensioning device;

said computer-controlled weight tensioning device, said at least two cables and said free weight support bar operatively cooperating such that tensioning force applied by said computer-controlled weight tensioning device via said at least two cables to said free weight support bar controllably decreases the amount of downwards force exerted by said free weight support bar due to the weight of said free weight support bar and weights thereon whereby a user of said free weight assistance and training device may receive assistance during lifting of said free weight support bar via said computer-controlled weight tensioning device; and a bar position detector device including two interconnected elements, a cable angle detection device and a bar position detection light curtain, each connected in information transmission connection with said computer-controlled weight tensioning mechanism, said cable angle detection device and said bar position detection light curtain cooperating to determine the position of said free weight support bar during a lift, said cable angle detection device mounted on said generally upright weight support structure generally adjacent each of said cables to detect the angles at which said cables depend from said generally upright weight support structure, said cable angle being computed in combination with the length of said cables to track the location of the free weight support bar thereby permitting the user of said free weight assistance and training device to maintain a better lift track during the lift thus reducing the chance of injury from improper lifting.

2. The free weight assistance and training device of claim 1 wherein said base comprises at least two base feet having leveling pads mounted on the undersides thereof.

3. The free weight assistance and training device of claim 1 wherein said generally upright weight support structure comprises at least one main weight support post mounted on and extending upwards from said base, and at least one weight support beam mounted atop each of said at least one main weight support posts and extending forwardly therefrom.

4. The free weight assistance and training device of claim 1 wherein said free weight support bar further comprises a handle grip sensing device mounted on said free weight support bar and in information transmission connection with said computer-controlled weight tensioning device, said handle grip sensing device operative to ensure that said free weight support bar is being gripped by a user of said free weight assistance and training device, and upon detecting release of said free weight support bar by a user, vertical movement of said free weight support bar is restricted via said computer-controlled weight tensioning device until said free weight support bar is again gripped by a user.

5. The free weight assistance and training device of claim 4 wherein said handle grip sensing device on said free weight support bar further comprises a pair of light-sensitive sensing units mounted on said free weight support bar, one adjacent each of a left and right weight stop and each facing inwards towards the center of free weight support bar, a pair of reflective disks movably mounted on said free weight support bar generally adjacent the center thereof, said reflective disks adapted for movement towards or away from said light-sensitive sensing units, each of said light-sensitive sensing units operative to send infrared beams of light outwards therefrom extending generally parallel with said free weight support bar towards said pair of reflective disks, the infrared beams being reflected back to said light-sensitive sensing units thereby signifying that non-use of said free weight assistance and training device, and alternatively, upon use of said free weight assistance and training device and placement of a user's hands on said free weight support bar, the infrared beams are interrupted, said light-sensitive sensing units signaling said computer-controlled weight tensioning device to confirm use and permitting movement of said free weight support bar.

6. The free weight assistance and training device of claim 1 wherein said computer-controlled weight tensioning device further comprises a computer-based control mechanism at least including a hard drive, motherboard with processor, memory, and software programmed to perform specified computing operations.

7. The free weight assistance and training device of claim 1 wherein said computer-controlled weight tensioning device comprises at least two cable reels mounted on rotatably mounted reel shafts operative to permit said at least two cable reels to rotate to extend or retract said cables which are wound thereon, the cable reel surface of each of said at least two cable reels being threaded to generally ensure accurate take-up of said cables such that each rotation of said at least two cable reels takes up a generally identical length of said cable.

8. The free weight assistance and training device of claim 7 further comprising at least two drive motors each having a drive shaft, each drive shaft of said at least two drive motors operatively connected to one of said at least two cable reels for rotation thereof in response to rotation of said drive shafts, said computer-controlled weight tensioning device further including at least two clutches each interposed between one of said drive shafts and one of said at least two cable reels such that said at least two clutches alternatively engage and disengage said drive shafts with said at least two cable reels for winding and unwinding said cables on said at least two cable reels.

9. The free weight assistance and training device of claim 8 further comprising at least two sensor units each mounted generally adjacent one of said at least two reel shafts, said at least two sensor units operative to detect the rotational speed, direction and amount of rotation of each of said at least two reel shafts, said at least two sensor units in information transmission connection with said computer-controlled weight tensioning device for transfer of said rotational speed, direction and amount of rotation information thereto.

10. The free weight assistance and training device of claim 9 wherein said at least two sensor units each comprise a rotatable optical disk each connected to one of said at least two reel shafts, said optical disks each including alternating light and dark radial sections, said at least two sensor units further including sensor devices operative to count the number and speed of the rotations of said optical disks via said alternating light and dark radial sections and forward that information to said computer-controlled weight tensioning device whereby the speed, direction and number of rotations of each of said at least two reel shafts is processable by said computer-controlled weight tensioning device.

11. The free weight assistance and training device of claim 10 further comprising a lift motor operative to engage said at least two reel shafts via said clutches such that said lift motor rotates said at least two reel shafts and said at least two cable reels to wind said at least two cables to alternatively raise and lower said free weight support bar by overpowering said drive motors.

12. The free weight assistance and training device of claim 11 further comprising at least two reel brakes operatively associated with said at least two reel shafts to alternatively permit and prevent rotation of said at least two reel shafts to wind and unwind said at least two cables.

13. The free weight assistance and training device of claim 1 further comprising a balance pad positioned generally below said free weight support bar on a floor surface and connected in information transmission connection with said computer-controlled weight tensioning mechanism, said balance pad operative to track the weight distribution of a user of said free weight assistance and training device during the lifting of said free weight support bar for increasing efficiency of the lift.

14. The free weight assistance and training device of claim 1 wherein said bar position detection light curtain is mounted on said generally upright weight support structure generally adjacent an upper section thereof and extending generally horizontally, said bar position detection light curtain operative to project a light curtain generally vertically downwards to a receiver bar mounted adjacent said base, said bar position detection light curtain further operative to detect interruption of said light curtain and transmit the horizontal location of the interruption to said computer-controlled weight tensioning mechanism such that as said free weight support bar is moved through said bar position detection light curtain, the horizontal interruptions of the light curtain are recorded and the computer-controlled weight tensioning mechanism can calculate and graph the horizontal path of said free weight support bar during a lift.

15. A free weight assistance and training device comprising:

a base;

a generally upright weight support structure mounted on and extending upwards from and over said base;

a free weight support bar;

a computer-controlled weight tensioning device mounted on said base generally adjacent said upright weight support structure;

at least two cables movably mounted on said upright weight support structure and extending between and connecting said free weight support bar and said computer-controlled weight tensioning device;

rotatably mounted reel means operatively connected to said computer-controlled weight tensioning device for winding said at least two cables thereon to extend and retract said at least two cables;

drive means operatively connection with said reel means for rotation thereof;

at least one sensor unit operatively connected to said computer-controlled weight tensioning device and said reel means operative to detect rotation of said reel means and signal said computer-controlled weight tensioning device regarding speed and direction of rotation of said reel means;

said at least one sensor unit comprising a rotatable optical disk including alternating light and dark radial sections, said at least one sensor unit further including a sensor device operative to count the number and speed of the rotations of said optical disk via said alternating light and dark radial sections and forward that information to said computer-controlled weight tensioning device whereby the speed, direction and number of rotations of said reel means is processable by said computer-controlled weight tensioning device;

said computer-controlled weight tensioning device, said at least two cables, said reel means, said at least one sensor unit and said free weight support bar operatively cooperating such that upon detection of stoppage of rotation of said reel means by said sensor means prior to completion of a lift, tensioning force is applicable by said computer-controlled weight tensioning device via said at least two cables to said free weight support bar to controllably decrease the amount of downwards force exerted by said free weight support bar due to the weight of said free weight support bar and weights thereon whereby a user of said free weight assistance and training device may receive assistance during lifting of said free weight support bar prior to completion of a lift via said computer-controlled weight tensioning device.

16. A free weight assistance and training device comprising:

a base;

a generally upright weight support structure mounted on and extending upwards from and over said base;

a free weight support bar;

a weight tensioning device mounted on said base generally adjacent said upright weight support structure;

a computer-based control device operatively connected to said weight tensioning device, said computer-based control device including software programming operative to control engagement and disengagement of said weight tensioning device in response to selected movement of said free weight support bar;

at least two cables movably mounted on said upright weight support structure and extending between and connecting said free weight support bar and said weight tensioning device;

rotatably mounted reel means operatively connected to said weight tensioning device for winding said at least two cables thereon to extend and retract said at least two cables;

drive means operatively connection with said reel means for rotation thereof;

at least one sensor unit operatively connected to said weight tensioning device, said computer-based control device and said reel means, said at least one sensor unit operative to detect rotation of said reel means and signal said computer-based control device regarding speed and direction of rotation of said reel means;

said at least one sensor unit comprising a rotatable optical disk including alternating light and dark radial sections, said at least one sensor unit further including a sensor device operative to count the number and speed of the rotations of said optical disk via said alternating light and dark radial sections and forward that information to said computer-controlled weight tensioning device whereby the speed, direction and number of rotations of said reel means is processable by said computer-controlled weight tensioning device;

said computer-based control device, said weight tensioning device, said at least two cables, said reel means, said at least one sensor unit and said free weight support bar operatively cooperating such that upon detection of stoppage of rotation of said reel means by said sensor means prior to completion of a lift, said computer-based control device commands said weight tensioning device to apply tensioning force to said free weight support bar via engagement of said drive means to apply rotational force to said reel means thus tensioning said at least two cables connected to said free weight support bar to controllably decrease the amount of downwards force exerted by said free weight support bar due to the weight of said free weight support bar and weights thereon whereby a user of said free weight assistance and training device may receive assistance during lifting of said free weight support bar prior to completion of a lift.

* * * * *